United States Patent [19]

Diffenderfer

[11] 4,004,386

[45] Jan. 25, 1977

[54] CONCRETE AND LINER RETAINER COPING

[76] Inventor: Harold C. Diffenderfer, 4196 Bannister, Breesport, N.Y. 14816

[22] Filed: Sept. 8, 1975

[21] Appl. No.: 611,274

[52] U.S. Cl. ..... 52/300; 52/169.7; 52/244; 4/172.21

[51] Int. Cl.[2] ..... E04H 12/00; E04H 3/18

[58] Field of Search ..... 52/169, 300, 102, 601, 52/244; 4/172, 172.18, 172.19, 172.20, 172.21, 172.17

[56] References Cited

UNITED STATES PATENTS

| | | | |
|---|---|---|---|
| 990,986 | 5/1911 | Jones | 52/244 |
| 1,538,766 | 5/1925 | Warndorff | 52/244 |
| 3,739,539 | 6/1973 | Posnick | 52/169 |
| 3,785,099 | 1/1974 | Greene | 52/102 |

*Primary Examiner*—James L. Ridgill, Jr.
*Attorney, Agent, or Firm*—Allison C. Collard

[57] ABSTRACT

A concrete and liner retainer coping for a pool and the like comprising an upper vertical wall having a top arcuate curved portion curving rearwardly in a direction away from the pool and formed with a vertically downwardly depending lip ending in a free edge thereof. A horizontal part extends rearwardly relative to the vertical wall and has at its free rear end an upwardly directed vertically oriented back lip. A connection portion integrally connects the horizontal portion to the vertical portion, and a lower vertical edge is joined to a front end of the horizontal part, the latter in cooperation with the connecting portion forming a mouth adapted to receive therein the liner.

3 Claims, 2 Drawing Figures

CONCRETE AND LINER RETAINER COPING

Figure 1:
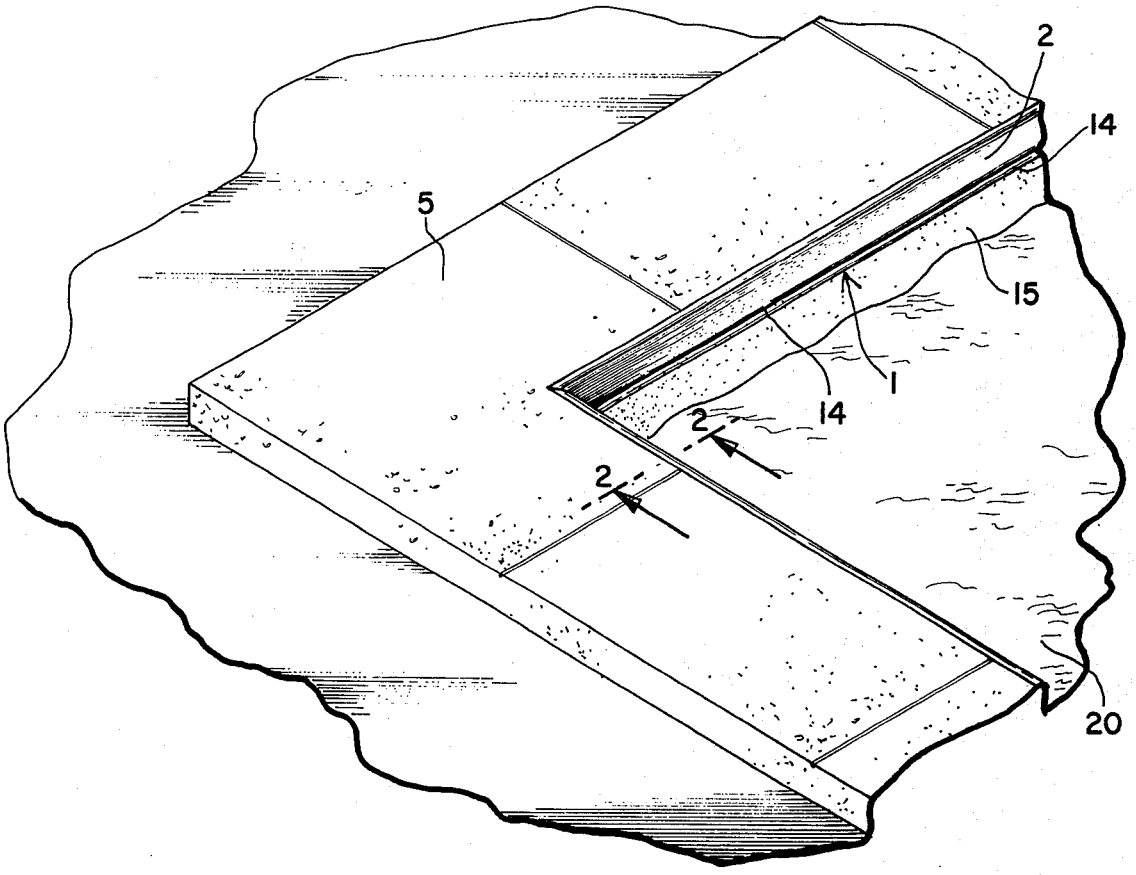

The present invention relates to a concrete and liner retainer coping for pools.

Various copings are known as a swimming pool edge construction which is positioned and attached adjacent the edge at the vertical pool side wall and the horizontal deck structure. Copings also act as a form for a concrete decking.

The copings of the prior art are complex in construction, requiring several supporting and matrix walls and do not function readily to achieve the purpose intended.

Accordingly, it is an object of the present invention to provide a concrete and liner coping which will readily fasten to any type pool wall permitting concrete to pour right to the pool edge allowing finishing to be easily performed.

It is also an object of the present invention to provide a concrete and liner retainer coping which is simple and inexpensive in production, easy to install and excellent in use.

It is still another object of the present invention to provide a concrete and liner coping for swimming pools which is completely extruded of aluminum or polyvinylchloride, is adapted to receive in snap-in engagement, a pool wall liner and concrete receptor.

Other objects and features of the present invention will become apparent from the following detailed description when taken in connection with the accompanying drawing which discloses several embodiments of the invention. It is to be understood that the drawing is designed for the purpose of illustration only, and is not intended as a definition of the limits and scope of the invention disclosed.

Figure 2:
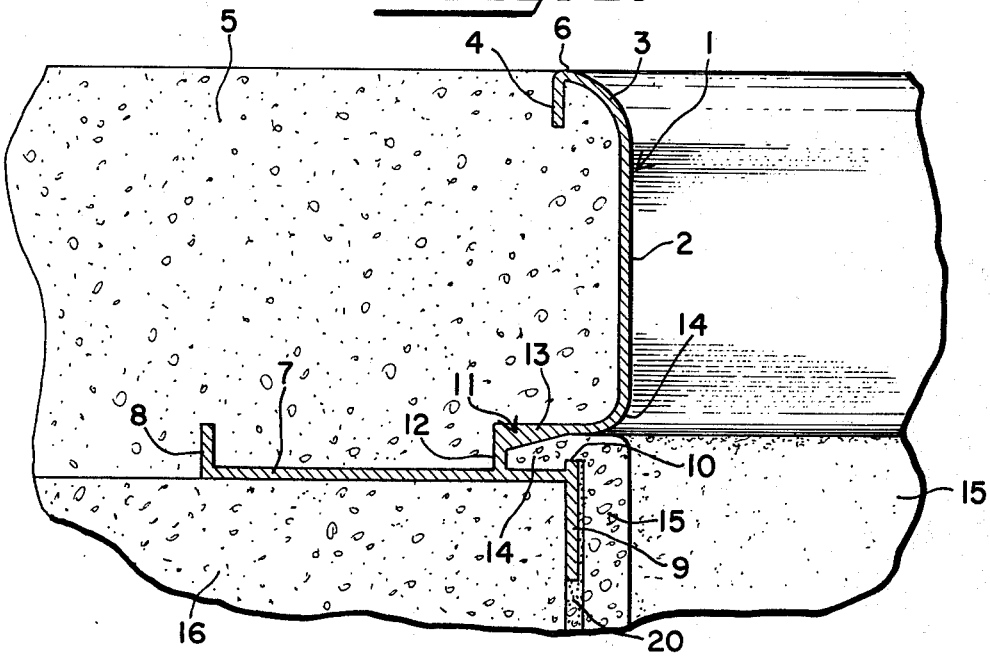

In the drawing, wherein similar reference numerals denote similar elements throughout the several views:

FIG. 1 is a perspective view of a corner of a swimming pool corner, partially broken away, showing a coping in accordance with the present invention in installed position, with poured concrete; and FIG. 2 is a section taken along the line 2—2 of FIG. 1.

Referring now to the drawing, and more particular to FIGS. 1 and 2, a concrete and liner retainer coping 1 in accordance with the present invention preferably comprises an all aluminum extruded member having a vertical wall 2 which is rearwardly curved at its upper portion at arcuate curve portion 3, then extending vertically downwardly to form a lip 4, which is to be embedded in a poured concrete 5, which is poured to the very top edge 6 of the coping 1, providing a perfect finishing of a concrete deck 5 around the pool. The coping 1 further includes a horizontal part 7 having a free upwardly directed vertically oriented back lip 8 which also is embedded in the concrete to hold the coping. The concrete will harden over this lip 8 which helps hold the coping to the wall. The concrete is poured right to the level of the smooth upper top 6 of the coping, and the coping in this way cooperates therewith to provide a suitable cover edge horizontally thereon whereby a person may walk without slipping. Incuse is finished, the smooth top 6 allows the concrete to be poured low; no sharp edges exist. The lip 4 is designed to be held when concrete is poured. When the concrete sets, it will firmly hold the top of the coping.

The coping member further includes a lower vertical edge 9 for cementing thereon, for example, one-eighth inch material such as a protection-foam 20 for protection of a liner 15. The upper ledge 10 of the edge 9 projects slightly above the horizontal part 7 which is integral with the edge 9 adjacent the upper ledge 10 and perpendicular relative thereto. A connection portion 11 extends from the horizontal part 7 at a position rearwardly from the edge 9 by about one-fifth of the length of the horizontal portion 7. The connection portion 11 extends upwardly in a first vertical connection part 12 and continues substantially horizontally in a second horizontal part 13 tapering thickness in a direction toward the vertical wall 2 and is connected to the latter via a rounded arcuate portion 14, the latter being disposed above and forwardly beyond the edge 9; the vertical edge 9 and the vertical wall 2 are parallel to each other and offset with the upper vertical wall 2 overlapping the edge 9 in the direction of the pool.

A mouth or receptacle opening 14 is formed between the forward end of the horizontal portion 7, the second vertical part 12, the horizontal part 13 of the connecting portion and the upper ledge 10 of the edge 9. The mouth 14 narrows in an inward direction (i.e., away from the pool) and a liner 15, which may be made of concrete or vinyl, for example, is snapped therein and is held permanently therein by the upper ledge 10 and cooperating tapering (dropped down metal) formation of the mouth 14, which pushes the liner clampingly against the ledge 10. The liner is thus assured of not coming loose.

A preferably steel reinforced concrete 16 forms the preformed wall of the pool, in the edge of which the coping is laid with the edge 9 facing the pool and the horizontal portion 7 sitting therein. The concrete 5 is then poured as above described. In this manner, the entire pool may be formed of concrete 16 forming the side walls of the pool, with the protective foam layer 20 being cemented on the wall 16 and the protective liner 15 extending all the way down adjacent thereon.

The coping in accordance with the present invention is preferably extruded of aluminum; a polyvinylchloride plastic also could be used of the same shape, since it could be bent easily for large radius corners. All corners may readily be premade to order and preferably the concrete and liner retainer coping of the present invention may be made in various sizes, depending upon the dimensions of the pool. It is easily electrostatically painted, e.g., white or of any other color, and with the present invention, no unsightly coping is maintained. The only coping portion that is seen is the upper portion 2. The coping 1 in accordance with the present invention will fasten to any type pool wall. The upper edge 10 is sharp, in order to retain the liner 15. All of the corners are smooth except the flange lips 4 and 8 which bite into the concrete and embed the coping. The upper edge 6 is smooth for ease in concrete finishing, so as to finish the concrete low, with no sharp edge provided to cut a person's feet. The liner 15 lays in the mouth 14 and eliminates the sharp edge 10, which at the same time is used to hold the liner therein. The particular curve of the corners 14 and 3 as well as the extent of the connection portion 13 which is about one-third the length of the horizontal portion 7 cooperates with the raised portion 12 forming a vertical perpendicular corner to retain the concrete 5 deck therein nicely, to hold the coping against the pool simply, and to permit a relative ease of operation and functional utility. The height of the vertical portion 12 is substantially equal to the height of the lip 8.

While only a single embodiment of the present invention has been shown and described, it will be obvious to those skilled in the art that many changes and modifications may be made thereunto without departing from the spirit and scope of the invention.

What is claimed is:

1. A concrete and liner retaining coping for mounting on the top surface of a pool wall and the like comprising:

a flat vertical wall terminating upwardly in a top arcuate curve portion curving rearwardly in a direction away from the pool and formed with a vertically downwardly depending lip substantially parallel to said vertical wall and ending in a free edge;

a horizontal portion for support on the top surface of the pool wall and extending rearwardly relative to said vertical wall and terminating at its free end in an upwardly directed vertically orientated back lip, said horizontal portion having on its opposite end a downwardly directed flange covering the edge of the top surface and an upwardly directed lip for retaining the liner.

said vertical wall terminating downwardly in a bottom arcuate curve portion curving rearwardly overlying a part of said horizontal portion and the downwardly directed flange defining a receptacle opening for receiving the liner; and a vertical connection portion integrally joining said horizontal portion to the bottom arcuate curve portion of said vertical wall and forming the back wall of said receptacle.

2. The concrete and liner retainer coping as recited in claim 1 wherein said vertical connection portion has a height substantially equal to that of said back lip.

3. The concrete and liner retainer coping as recited in claim 1 wherein the bottom arcuate curve portion of said vertical wall tapers in a direction toward said vertical connecting portion.

* * * * *